US008186996B2

(12) United States Patent
Ojiro

(10) Patent No.: US 8,186,996 B2
(45) Date of Patent: May 29, 2012

(54) COMBUSTION APPARATUS

(75) Inventor: Takashi Ojiro, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 592 days.

(21) Appl. No.: 12/396,641

(22) Filed: Mar. 3, 2009

(65) Prior Publication Data

US 2009/0226854 A1 Sep. 10, 2009

(30) Foreign Application Priority Data

Mar. 4, 2008 (JP) ..... 2008-053633

(51) Int. Cl.
*F23D 14/62* (2006.01)
*A47J 37/07* (2006.01)

(52) U.S. Cl. ..... 431/351; 431/181; 431/12; 431/354; 431/217; 126/92 R; 126/92 AC; 126/41 R

(58) Field of Classification Search ..... 431/351, 431/181, 12; 126/92 R, 92 AC
See application file for complete search history.

(56) References Cited

U.S. PATENT DOCUMENTS 2,376,571 A * 5/1945 Brumbaugh ..... 126/39 C
3,448,736 A * 6/1969 Shenberger ..... 126/116 R
3,553,913 A * 1/1971 Eisenberg ..... 52/172
4,092,975 A * 6/1978 Grammatopoulos ..... 126/41 R
4,589,843 A * 5/1986 Smith ..... 432/59
6,208,066 B1 * 3/2001 Kokubu et al. ..... 313/141
6,284,332 B1 * 9/2001 Buettner et al. ..... 428/34.4
6,621,054 B2 * 9/2003 Von Mosshaim ..... 219/452.11
7,931,468 B2 * 4/2011 Ojiro et al. ..... 431/354
7,955,072 B2 * 6/2011 Ojiro et al. ..... 431/181

FOREIGN PATENT DOCUMENTS

JP 2007-292342 11/2007

* cited by examiner

*Primary Examiner* — Steven B McAllister
*Assistant Examiner* — Nikhil Mashruwala
(74) *Attorney, Agent, or Firm* — Rankin, Hill & Clark LLP

(57) ABSTRACT

Provided is a combustion apparatus capable of preventing a heat loss from a combustion cabinet without deteriorating a combustion performance thereof. According to the present invention, a part of an inner side surface of a combustion cabinet (1), which encloses a combustion chamber where a mixture gas erupted from a combustion plate (22) is combusted, is covered with a cover (7) made of an insulation material; and the cover (7) is provided with a concave portion (7*a*) at an outer side surface thereof having contact with the inner side surface of the combustion cabinet (1), and an insulation air layer (7*b*) is defined by the concave portion (7*a*).

13 Claims, 4 Drawing Sheets

COMBUSTION APPARATUS

PRIORITY CLAIM

The present application is based on and claims the priority benefit of Japanese Patent Application 2008-053633 filed on Mar. 4, 2008, the contents of which are incorporated herein by reference in its entirety.

BACKGROUND OF THE INVENTION

1. Field of the Invention

The present invention relates to a combustion apparatus provided with an all primary combustion burner for supplying hot water or the like.

2. Description of the Related Art

Conventionally, there has been known a combustion apparatus for supplying hot water which is composed of an all primary combustion burner and a combustion cabinet. On the top of the combustion cabinet, there is disposed a heat exchanger; and the all primary combustion burner having a combustion plate with a plurality of burner ports is disposed inside the combustion cabinet. This kind of the combustion apparatus having the all primary combustion burner has an advantage in making the apparatus compact sized; on the contrary, however, it has a problem that heat loss is easy to occur when the combustion cabinet becomes hot.

In regard to this problem, there has been known a combustion apparatus as disclosed in, for example, Japanese Patent Laid-open No. 2007-292342, in which a ventilation gap between an outer side surface of the burner and an inner side surface of the combustion cabinet in the conventional art is maintained, and the ventilation gap is supplied with air from a fan as cooling air to form a cooling air curtain circulating on the top of the burner along the inner side surface of the combustion cabinet while the fan blows air to the burner as primary air.

According to the combustion apparatus described in the above, the combustion cabinet is cooled by the air curtain; resultantly, the heat loss of the combustion cabinet is prevented. On the other hand, however, a part of the cooling air in the ventilation gap flows into and circulates above i peripheral area of the combustion plate, and they are mixed into a mixture gas erupted from the burner ports in the peripheral area before the mixture gas is completely combusted. As a result, the air excess rate in the mixture gas becomes extremely high, which lifts up the flames from the combustion ports in the peripheral area of the combustion plate, leading to a deteriorated combustion performance.

SUMMARY OF THE INVENTION

The present invention has been accomplished in view of the aforementioned problems, and it is therefore an object of the present invention to provide a combustion apparatus capable of preventing a heat loss from a combustion cabinet without deteriorating a combustion performance thereof.

To attain an object described above, the combustion apparatus according to the present invention is provided with an all primary combustion burner, which has a combustion plate with a plurality of burner ports disposed on the top thereof, in a combustion cabinet, wherein a part of an inner side surface of the combustion cabinet which encloses a combustion chamber where a mixture gas erupted from the combustion plate is combusted is covered with a cover made of an insulation material; and the cover is provided with a concave portion at an outer side surface thereof having contact with the inner side surface of the combustion cabinet, and an insulation air layer is defined by the concave portion.

According to the present invention, the heat from the combustion flames of the mixture gas can be prevented from being transferred to the combustion cabinet by the cover. Therefore, it is not necessary to circulate cooling air between the outer side surface of the burner and the inner side surface of the combustion cabinet, and resultantly, the combustion performance will not be deteriorated by the circulation of the cooling air in the peripheral area of the combustion plate. However, if the cover is solid, the cover will become very hot as the combustion continues. The heat will be transferred from the cover to the combustion cabinet, making the combustion cabinet excessively hot. In regard to this problem, the present invention defines the insulation air layer with the concave portion in the outer side surface of the cover to inhibit the heat transferred from the cover to the combustion cabinet so as to effectively prevent the heat loss from the combustion cabinet.

It is preferable that the insulation air layer according to the present invention is configured to have a thickness in a range of 28% to 44% with respect to a total thickness of the cover from an inner side surface of the combustion cabinet to the inner side surface of the cover. If the thickness of the insulation air layer is smaller than 28% of the total thickness of the cover, the insulation effect of the insulation air layer cannot be obtained effectively; on the other hand, however, if the thickness of the insulation air layer is greater than 44% of the total thickness of the cover, the part of the cover opposing to the insulation air layer becomes too thin to prevent the heat amount from entering the insulation air layer, causing the temperature of the insulation air layer to rise, which makes the combustion cabinet excessively hot.

Moreover, according to the present invention, it is desirable that an upper edge of the inner side surface of the cover is formed with a beveled portion. By forming the beveled portion at the upper edge of the inner side surface of the cover, it is difficult for the cover to absorb heat than the case where the upper edge of the inner side surface thereof is angular, thereby, to improve the insulation performance.

DETAILED DESCRIPTION OF THE PREFERRED EMBODIMENTS

Figure 1:
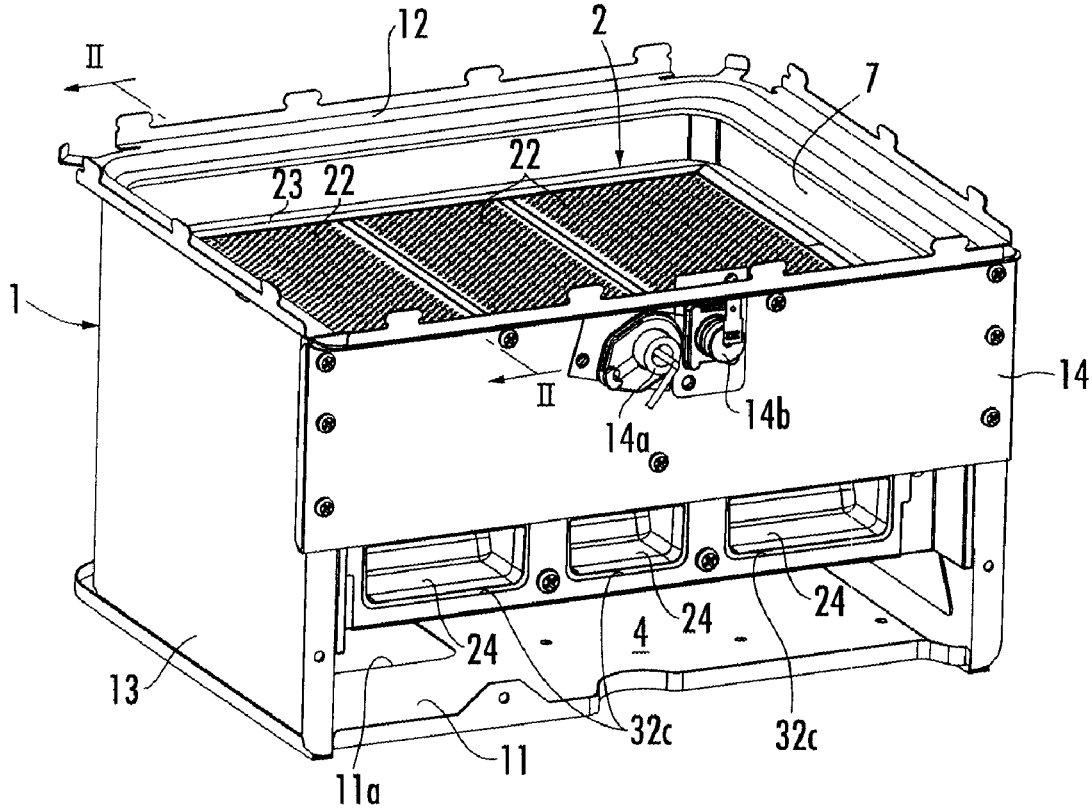
FIG. 1 is a perspective view of a combustion apparatus according to an embodiment of the present invention.

As illustrated in FIG. 1, reference numeral 1 denotes a combustion cabinet. On the top thereof, there is disposed an object to be heated (not shown) such as a heat exchanger for supplying hot water or the like. Inside the combustion cabinet 1, there is disposed an all primary combustion burner 2.

Figure 2:
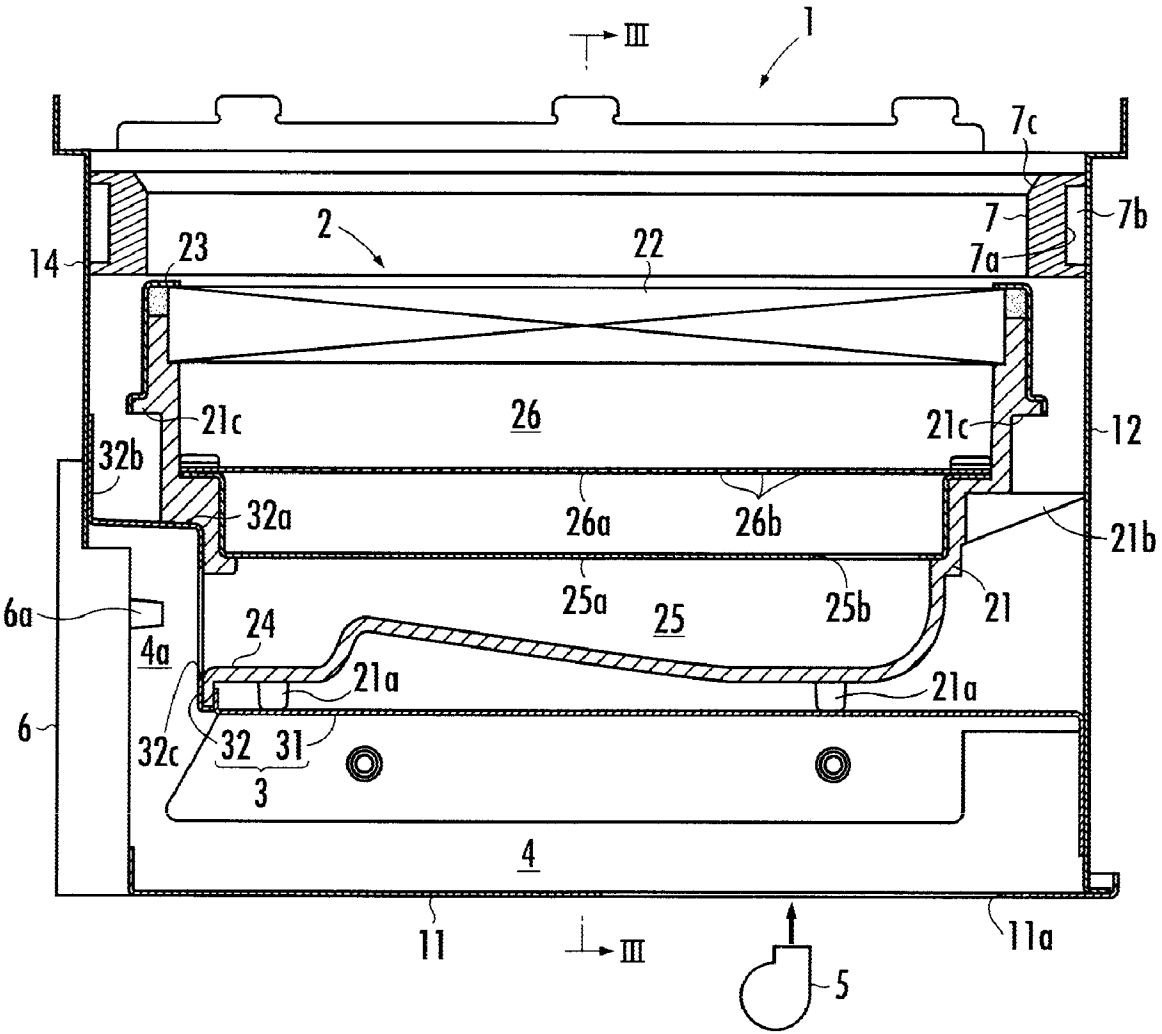
FIG. 2 is a side view of the combustion apparatus illustrated in FIG. 1 cut away along II-II line.
Figure 3:
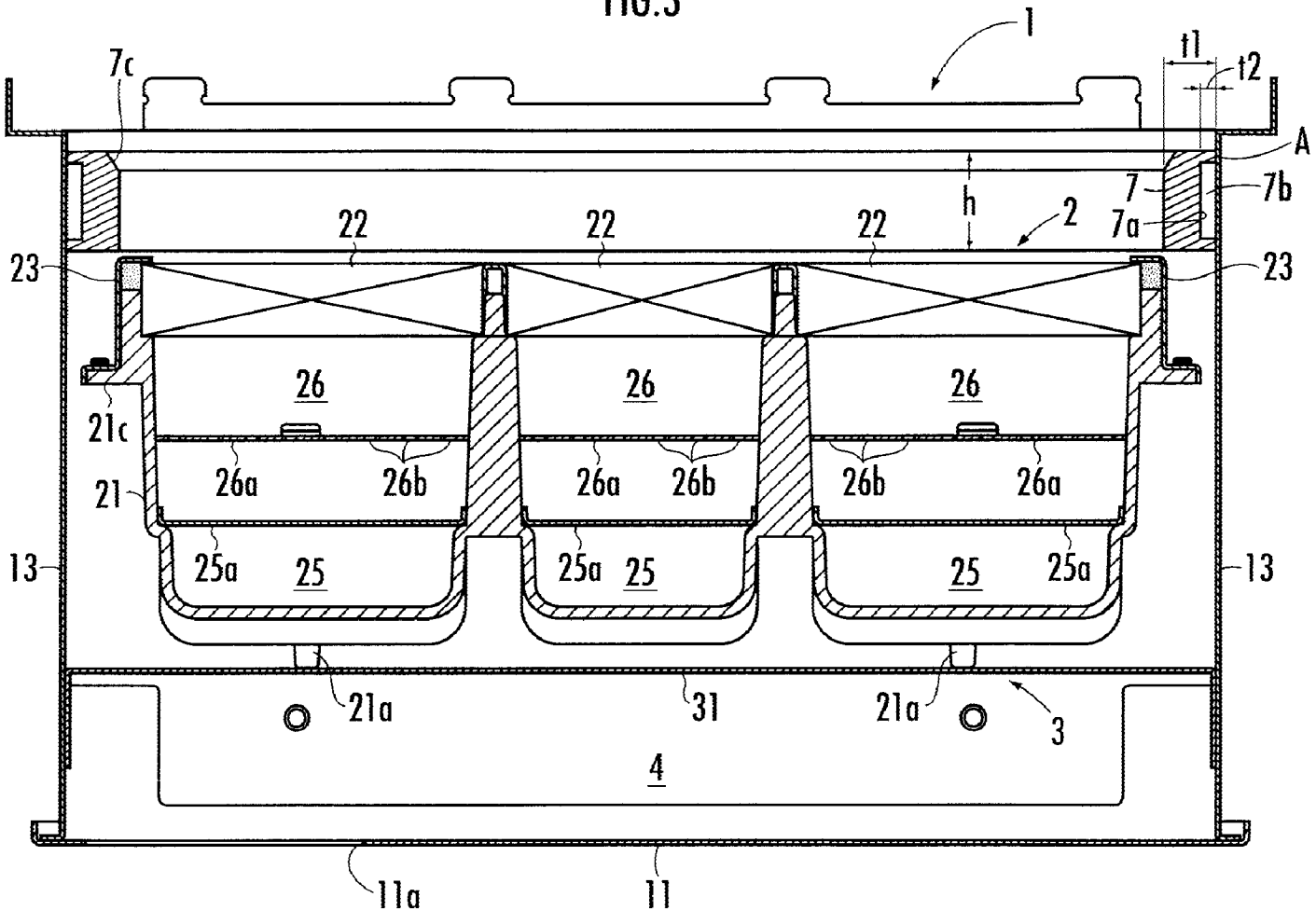
FIG. 3 is a front view of the combustion apparatus illustrated in FIG. 2 cut away along III-III line.

The combustion cabinet is constituted of a bottom plate 11, a rear plate 12 and two side plates 13 and 13 formed by bending a single piece of plate, and a front plate 14 fixed at an upper position between front ends of the two side plates 13 and 13. The front plate 14 is provided with an ignition plug 14*a* and a flame detection element 14*b* such as a flame rod and so forth. As illustrated in FIG. 2 and FIG. 3, the combustion cabinet 1 is disposed with an air supply chamber 4 which is located at a lower position than the burner 2. The air supply chamber 4 is demarcated by a partition plate 3. In the bottom plate 11, there is opened a connection port 11*a*. An air supply duct of a fan 5 is plugged into the connection port 11*a* and supplies the air supply chamber 4 with air from the fan 5. The partition plate 3 is constituted of an under plate portion 31 for supporting the burner 2 and a front plate portion 32 which is fixed at a lower position of a front surface of the burner 2 and is also served as a damper for defining a primary air chamber 4*a* leveled up in the front portion of the air supply chamber 4. The upper end of the front plate portion 32 is formed with a protection portion 32*a* which is bent frontward and acts as a top surface of the primary air chamber 4*a* and a flange portion 32*b* which is bent from the front end of the protection portion 32*a* upward and is joined to a lower portion of a back surface of the front plate 14.

As illustrated in FIG. 2 and FIG. 3, the burner 2 is a plate-type burner comprising a burner main body 21 and a combustion plate 22 mounted at the top of the burner main body 21. The burner main body 21 is of a box shape, provided with a support leg portion 21*a* and a spacer portion 21*b*, both of which are protruding out of the burner main body 21. The support leg portion 21*a* is disposed at a lower surface of the burner 2 and is seated on the under plate portion 31 of the partition plate 3. The spacer portion 21*b* is disposed at a rear surface of the burner 2 and is adjoined to the rear plate 12 of the combustion cabinet 1. The combustion plate 22 is made of ceramics and is configured to have a plurality of burner ports at a top surface of the burner main body 21. The combustion plate 22 is prevented from loosing from the burner main body 21 by a tension frame 23 which presses the combustion plate 22 downward at a circumferential edge of an upper surface thereof. A flange portion 21*c* which is a protruded portion spread circumferentially is disposed on an outer side surface of the burner main body 21 at a lower position than the combustion plate 22, and the tension frame 23 is fixed at the flange portion 21*c*.

An inflow port 24 is opened at a lower portion of the front surface of the burner main body 21. The inflow port 24 communicates with the primary air chamber 4*a* through an opening 32*c* formed in the front plate portion 32 of the partition plate 3 which is fixed at the lower portion of the front surface of the burner main body 21. Inside the burner main body 21, there are provided a mixing chamber 25 which is located at a lower position and extends rearward from the inflow port 24, and a distribution chamber 26 which is located at a higher position than the mixing chamber 25 and communicates with the mixing chamber 25 through an opening 25*b* formed at a rear portion of an upper surface plate 25*a* of the mixing chamber 25. A distribution plate 26*a* is provided in the distribution chamber 26 to demarcate the distribution chamber 26 into an upper chamber section and a lower chamber section. The distribution plate 26*a* is formed with a plurality of distribution ports 26*b* so as to keep uniform the pressure in the distribution chamber 26 between the combustion plate 22 and the distribution plate 26*a*. The combustion plate 22 is divided into 3 parts in the lateral direction. Similarly, the inflow port 24, the mixing chamber 25 and the distribution chamber 26 are divided into 3 parts in the lateral direction as well. Therefore, the burner 2 of the present invention is essentially a combination of 3 burners.

A front surface of the primary air chamber 4*a* is occluded by a gas manifold 6. The gas manifold 6 is provided with a gas nozzle 6*a*, facing the inflow port 24. Thereby, fuel gas from the gas nozzle 6*a* and the primary air from the primary air chamber 4*a* are flown into the mixing chamber 25 of the burner 2 and are mixed therein to produce a mixture gas having a fuel gas concentration lower than a theoretical air-fuel ratio. The mixture gas is erupted from the burner ports in the combustion plate 22 through the distribution chamber 26 and is subjected to an all primary combustion. Note that the gas manifold 6 is omitted and not shown in FIG. 1.

A part of an inner side surface of the combustion cabinet 1 which encloses a space for the mixture gas erupted from the combustion plate 22 to combust therein is provided with a cover 7. The cover 7 is molded from an insulation material of superior thermal insulation properties, such as glass wool and so forth, to have a cross sectional shape similar to a laid capital letter "U" (the capital letter "U" is placed horizontally after being rotated for 90 degrees). A concave portion 7*a* is formed at an outer side surface, which has contact with the inner side surface of the combustion cabinet 1, of the cover 7 to define an insulation air layer 7*b*.

According thereto, the heat from the combustion flames of the mixture gas can be prevented from being transferred to the combustion cabinet 1 by the cover 7. Therefore, it is not necessary to circulate cooling air between the outer side surface of the burner 2 and the inner side surface of the combustion cabinet 1, and resultantly, the combustion performance will not be affected by the circulation of the cooling air in the peripheral area of the combustion plate 22. However, if the cover 7 is solid, the cover 7 itself will become very hot as the combustion continues. The heat will be transferred from the cover 7 to the combustion cabinet 1, making the combustion cabinet 1 excessively hot. In regard to this problem, the present invention defines the insulation air layer 7*b* at the inner side surface of the cover 7 to inhibit the heat from being transferred from the cover 7 to the combustion cabinet 1 so as to effectively prevent the heat loss from the combustion cabinet 1.

If the thickness of the insulation air layer 7*b* is too thin, the insulation effect of the insulation air layer cannot be obtained effectively.

On the other hand, however, if the thickness of the insulation air layer 7*b* is too thick, the part of the cover 7 opposing to the insulation air layer 7*b* becomes too thin to prevent the heat produced by the combustion flames from entering the insulation air layer 7*b*, causing the temperature of the insulation air layer 7*b* to rise, which makes the combustion cabinet 1 excessively hot.

Therefore, a test was carried out to find a preferable thickness of the insulation air layer 7*b*. The cover 7 tested has an entire thickness t1 of 9 mm which is counted from the inner side surface of the combustion cabinet1 to the inner side surface of the cover 7. The entire thickness t1 is substantially equal to a gap between the outer side surface of the upper portion of the burner main body 21 and the inner side surface of the cabinet 1. A plurality of covers 7 with insulation air layer 7*b* of different thickness t2 were tested. A vertical dimension h of the cover 7 is set at 20 mm and a vertical dimension of the insulation air layer 7*b* is set at 14 mm. Moreover, an upper edge of the inner side surface of the cover 7 is formed with a beveled portion 7*c* by cutting away the corner for 2 mm.

Figure 4:
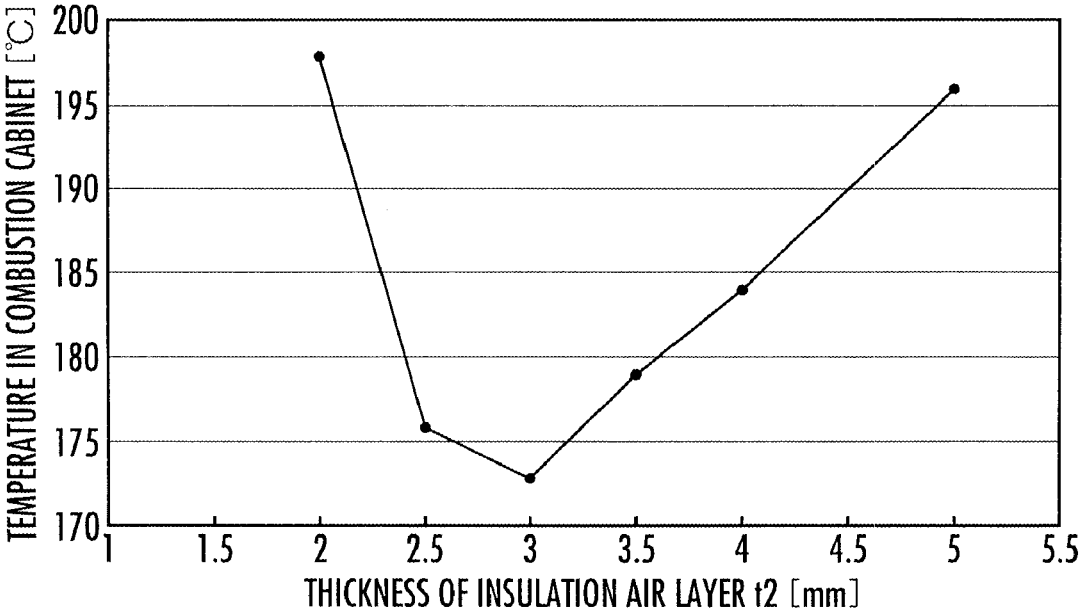
FIG. 4 is a graph illustrating a relationship between a thickness of an insulation air layer and a temperature of a combustion cabinet in the combustion apparatus of an embodiment.

In the test, an input power of the burner 2 is set at 48.8 kW and the air excess rate is set at 1.15, a temperature at a portion (point A in FIG. 3) where the upper end of the cover 7 has contact with the combustion cabinet 1, which will become the hottest part of the combustion cabinet 1, was determined. The determination result is shown in FIG. 4. It is clear from FIG. 4 that the temperature at the point A went up to only 173° C. when the thickness t2 of the insulation air layer 7*b* was 3 mm. However, when t2 is smaller than 3 mm, the temperature at the point A rises at an accelerated rate in accordance to the decrement of t2; on the other hand, when t2 is greater than 3 mm, the temperature at the point A rises in proportion to the increment of t2. If t2 is set in a range of 2.5 mm to 4.0 mm, the temperature at the point A remains below 185° C., and the heat loss from the combustion cabinet 1 can be prevented accordingly. Note that if the entire thickness t1 of the cover 7 is altered, it is preferable that the thickness t2 of the insulation air layer 7*b* be altered in proportion to t1. The entire thickness t1 of the cover 7 used in the test is 9 mm, when t2 is at 2.5 mm, the rate of t2 with respect to t1 is roughly 28% which is obtained by 2.5/9; and when t2 is at 4.0 mm, the rate of t2 with respect to t1 is roughly 44% which is obtained by 4/9. Therefore, the heat loss from the combustion cabinet 1 can be prevented effectively by setting the thickness t2 of the insulation air layer 7*b* in a range of 28% to 44% with respect to the entire thickness t1 of the cover 7.

Moreover, it is easy for the cover 7 to absorb heat when the upper edge of the inner side surface thereof is angular. In regard to the problem, as mentioned in the above, by forming the beveled portion 7*c* at the upper edge of the inner side surface of the cover 7, it is difficult for the cover 7 to absorb heat, thereby, to improve the insulation performance.

What is claimed is:

1. A combustion apparatus provided with an all primary combustion burner housed in a combustion cabinet, the all primary combustion burner having a combustion plate with a plurality of burner ports disposed on a top thereof, and the combustion cabinet having an inner side surface which encloses a combustion chamber where a mixture gas erupted from the combustion plate is combusted, wherein a cover made of an insulating material covers a part of the inner side surface of the combustion cabinet;

wherein the cover has an outer side surface disposed to be in contact with the inner side surface of the combustion cabinet, and a cover inner side surface opposite to the outer side surface of the cover, the outer side surface of the cover having a recessed portion defined therein such that the outer side surface of the cover and the inner side surface of the combustion cabinet enclose an insulation air layer area, the insulation air layer area bounded by the outer side surface of the cover and the inner side surface of the combustion cabinet so as to be provided by the recessed portion defined in the outer side surface of the cover; and wherein the cover is formed such that the insulation air layer area has a thickness in a range of 28% to 44% of a total thickness of the cover from the inner side surface of the combustion cabinet to the inner side surface of the cover;

wherein an upper edge of the cover inner surface is formed with a beveled portion;

wherein the cover is disposed so as to be entirely above an uppermost position of the all primary combustion burner.

2. The combustion apparatus according to claim 1, wherein the cover includes a lower side surface facing a bottom of the combustion apparatus, and an upper side surface opposite to the lower side surface, the upper side surface and lower side surface of the cover being connected by the outer side surface of the cover and the cover inner side surface, and an intersection of the cover inner side surface and the upper side surface of the cover is the upper edge of the cover inner side surface which is formed as the beveled portion.

3. The combustion apparatus according to claim 1, wherein the combustion cabinet has an upper edge spaced from an uppermost portion of the all primary combustion burner, and the cover is entirely disposed between the upper edge of the combustion cabinet and the uppermost portion of the all primary combustion burner.

4. The combustion apparatus according to claim 1, wherein the outer side surface of the cover includes an upper leg disposed at an upper portion thereof, a lower leg disposed at a lower portion thereof, and a recessed surface which is recessed from a distal end of the upper and lower legs and is disposed between the upper and lower legs, the recessed surface and the upper and lower legs defining the recessed portion of the cover, and the distal end of the upper leg and the distal end of the lower leg abut the inner side surface of the combustion cabinet, and the recessed surface is spaced from the inner side surface of the combustion cabinet.

5. The combustion apparatus according to claim 1, wherein the cover and the inner side surface of the combustion cabinet cooperate to bound the insulation air layer area such that the insulation air layer area continuously and entirely surrounds the all primary combustion burner.

6. The combustion apparatus according to claim 1, wherein the cover is formed from four leg portions joined such that the cover has a hollow rectangular shape when viewed from above.

7. The combustion apparatus according to claim 6, wherein each of the cover leg portions have an outer side surface with a recessed portion defined therein, and the outer side surface of each of the cover leg portions is in contact with the inner side surface of the combustion cabinet.

8. The combustion apparatus according to claim 2, wherein the cover is disposed such that the lower side surface of the cover is entirely above an uppermost portion of the all primary combustion burner.

9. The combustion apparatus according to claim 2, wherein the combustion cabinet has an upper edge spaced from an uppermost portion of the all primary combustion burner, and the cover is disposed such that the upper side surface of the cover is entirely below the upper edge of the combustion cabinet and lower side surface of the cover is entirely above the uppermost portion of the all primary combustion burner.

10. The combustion apparatus according to claim 2, wherein the outer side surface of the cover includes an upper leg disposed at an upper portion thereof, a lower leg disposed at a lower portion thereof, and a recessed surface which is recessed from a distal end of the upper and lower legs and is disposed between the upper and lower legs, the recessed surface and the upper and lower legs defining the recessed portion of the cover, and the distal end of the upper leg and the distal end of the lower leg abut the inner side surface of the combustion cabinet, and the recessed surface is spaced from the inner side surface of the combustion cabinet.

11. The combustion apparatus according to claim 2, wherein the cover and the inner side surface of the combustion cabinet cooperate to bound the insulation air layer area such that the insulation air layer area continuously and entirely surrounds the all primary combustion burner.

12. The combustion apparatus according to claim 11, wherein each of the cover leg portions have an outer side surface with a recessed portion defined therein, and the outer side surface of each of the cover leg portions is in contact with the inner side surface of the combustion cabinet.

13. The combustion apparatus according to claim 2, wherein the cover is formed from four leg portions joined such that the cover has a hollow rectangular shape when viewed from above.

* * * * *